US012624617B1

(12) United States Patent
Schneider et al.

(10) Patent No.: US 12,624,617 B1
(45) Date of Patent: May 12, 2026

(54) STAB AND HINGE OVER SYSTEM AND METHODS OF USE THEREOF

(71) Applicant: OneSubsea IP UK Limited, London (GB)

(72) Inventors: Nils Schneider, Celle (DE); Christoph Thiele, Celle (DE)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 19/253,117

(22) Filed: Jun. 27, 2025

(51) Int. Cl.
*E21B 43/013* (2006.01)
*E21B 33/035* (2006.01)

(52) U.S. Cl.
CPC ..... *E21B 43/013* (2013.01); *E21B 33/0387* (2020.05)

(58) Field of Classification Search
CPC ..... E21B 43/013; E21B 43/01; E21B 19/00; E21B 41/04; E21B 41/06; E21B 41/08
USPC ..... 166/338
See application file for complete search history.

(56) References Cited

U.S. PATENT DOCUMENTS 8,985,219 B2 * 3/2015 Cruden ..... E21B 33/038 166/341
10,753,182 B2 8/2020 Cargol, Jr.
12,037,878 B2 * 7/2024 Lundheim ..... F16L 1/26
2004/0226722 A1 * 11/2004 Colyer ..... E21B 33/038 166/360
2008/0286050 A1 * 11/2008 DeLack ..... E21B 43/013 405/172
2010/0038090 A1 * 2/2010 Barratt ..... H02G 1/10 166/341
2013/0321223 A1 * 12/2013 Bokenfohr ..... H01Q 1/04 343/719
2015/0176340 A1 * 6/2015 Bastesen ..... E21B 17/046 166/345
2025/0198261 A1 * 6/2025 Abdul ..... E21B 41/0007

* cited by examiner

*Primary Examiner* — Nicole Coy
*Assistant Examiner* — Douglas S Wood
(74) *Attorney, Agent, or Firm* — Kyle R. Miiller

(57) ABSTRACT

Aspects of the present disclosure provide an umbilical termination assembly (UTA). The UTA including a body, an umbilical, and a stab-in member. The body includes an umbilical connection and internal circuitry. The umbilical is configured to transmit information and power via electrical signals from a top side to the internal circuitry via the umbilical connection. The stab-in member is coupled to and protruding from the body. The stab-in member includes a stab-in electrical coupler. The stab-in electrical coupler is communicatively coupled to the internal circuitry and the umbilical connection and is configured to electrically couple the umbilical connection and internal circuitry to a base structure.

20 Claims, 3 Drawing Sheets

STAB AND HINGE OVER SYSTEM AND METHODS OF USE THEREOF

BACKGROUND

The present disclosure generally relates to the oil and gas industry. More specifically, the present disclosure relates to stab and hinge over (SHO) systems. SHO systems are used to make connections between a top side (e.g., a vessel above a subsea oil and gas system) and subsea components. SHO systems are crucial to the operation of subsea oil and gas operations. Accordingly, there is a continuous need for improved SHO systems.

SUMMARY

Aspects of the present disclosure provide an umbilical termination assembly (UTA). The UTA including a body, an umbilical, and a stab-in member. The body includes an umbilical connection and internal circuitry. The umbilical is configured to transmit information and power via electrical signals from a top side to the internal circuitry via the umbilical connection. The stab-in member is coupled to and protruding from the body. The stab-in member includes a stab-in electrical coupler. The stab-in electrical coupler is communicatively coupled to the internal circuitry and the umbilical connection and is configured to electrically couple the umbilical connection and internal circuitry to a base structure.

Aspects of the present disclosure provide a stab and hinge over (SHO) system. The SHO system includes a guide system, a base structure, and an umbilical termination assembly (UTA). The base structure is disposed on a sea floor below a top side and includes a receiving electrical coupler. The UTA includes a body, an umbilical, and a stab-in member. The body is coupled to the guide system and includes an umbilical connection and internal circuitry. The umbilical is configured to transmit information and power via electrical signals from the top side to the internal circuitry via the umbilical connection. The stab-in member is coupled to and protruding from the body. The stab-in member includes a stab-in electrical coupler. The stab-in electrical coupler is communicatively coupled to the internal circuitry and the umbilical connection and is configured to electrically couple the umbilical connection and internal circuitry to the receiving electrical coupler.

Aspects of the present disclosure provide a method of making an electrical connection. The method includes guiding an umbilical termination assembly (UTA) into engagement with a subsea base structure and electrically coupling the UTA with a base structure. The UTA includes a body, an umbilical, and a stab-in member. The body includes an umbilical connection and internal circuitry. The umbilical is configured to transmit information and power via electrical signals from a top side to the internal circuitry via the umbilical connection. The stab-in member is coupled to and protrudes from the body. The stab-in member includes a stab-in electrical coupler. The stab-in electrical coupler is communicatively coupled to the internal circuitry and the umbilical connection. Electrically coupling the UTA with the subsea base structure includes guiding the stab-in member into a receptacle of the base structure and coupling the stab-in electrical coupler with a receiving electrical coupler of the subsea base structure.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments. It is emphasized that, in accordance with the standard practice in the industry, various features are not drawn to scale. In fact, the dimensions of the various features may be arbitrarily increased or reduced for clarity of discussion.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Illustrative examples of the subject matter claimed below will now be disclosed. In the interest of clarity, not all features of an actual implementation are described in this specification. It will be appreciated which in the development of any such actual implementation, numerous implementation-specific decisions may be made to achieve the developers' specific goals, such as compliance with system-related and business-related constraints, which will vary from one implementation to another. Moreover, it will be appreciated which such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

For the sake of brevity, all similar components have been given similar reference numbers with the same last two digits and a full description of such similar components may not be repeated herein. Similarly, for the sake of brevity, all like components have been given the same reference numbers, and a full description of such components may not be repeated herein.

Aspects of the present disclosure provide a stab and hinge over (SHO) system and methods of use thereof. The SHO system includes a guide system, a base structure, and an umbilical termination assembly (UTA). The guide system guides the UTA into engagement with the base structure from the top side. The UTA includes a body, an umbilical, and a stab-in member. The umbilical transmits information, power, signals, and in some cases, fluids (e.g., chemicals and hydraulics) from a top side to internal circuitry (e.g., electric or fluidic circuitry) within the body of the UTA. The stab-in member is shaped and configured to guide the UTA into engagement with the base structure. The stab-in member further includes a coupler (e.g., a fluidic and/or electrical coupler) communicatively and/or electrically and/or fluidly coupled to the internal circuitry of the UTA that is configured to engage with a coupler (e.g., a fluidic and/or electrical coupler) of the base structure. Accordingly, the stab-in member guides the UTA into engagement with the base structure and communicatively and/or electrically and/or fluidly couples the UTA (and the top side) to the base structure.

Figure 1:
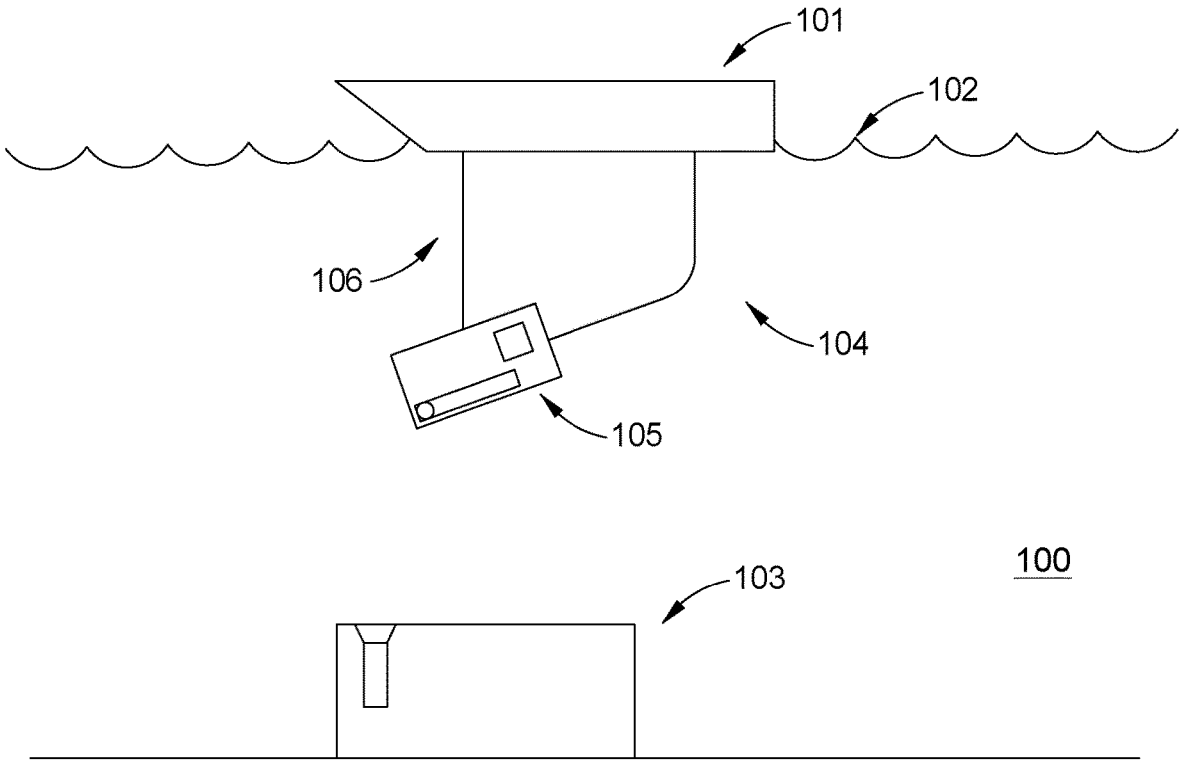
FIG. 1 illustrates a schematic view of an exemplary subsea operation, according to one or more embodiments.

FIG. 1 illustrates an exemplary subsea operation 100. As shown, the subsea operation 100 is a stop and hinge over (SHO) system. The exemplary subsea operation 100 includes a vessel 101 disposed at a top side 102 (e.g., a sea surface). While the vessel 101 is illustrated as a ship, the vessel 101 may include any surface equipment used in the oil and gas industry (i.e., a floating production storage and offloading (FPSO) installation). The vessel 101 may include surface equipment such as control systems configured to conduct subsea oil and gas operations. The vessel 101 is coupleable to a subsea base structure 103 via an umbilical 104. The subsea base structure 103 may be on the seafloor and may include subsea wells, Christmas trees, control modules, or other related subsea equipment for extraction and/or distribution of a liquid and/or gaseous product from under the sea bed. According to one mode of operation, the umbilical 104 may be used for transmitting information, power, electricity, signals, and/or fluids (e.g., hydraulic fluids and chemicals) to the subsea base structure 103.

An umbilical termination assembly (UTA) 105 is used to couple the umbilical 104 to the subsea base structure 103. According to one mode of operation, the UTA 105 is coupled to an end of the umbilical 104 and the UTA 105 is lowered toward the subsea base structure 103. According to one or more embodiments, the UTA 105 is lowered by a guide system 106 (e.g., a cable or crane or other lowering equipment of the vessel 101) and, optionally, is guided by a remote operating vehicle (ROV). Once the UTA 105 reaches the subsea base structure 103, the UTA 105 is guided into engagement with the subsea base structure 103. The umbilical 104 is simultaneously or subsequently coupled to the subsea base structure 103 by the UTA 105, thereby coupling the vessel 101 to the subsea base structure 103 to allow communication between the two for transmitting power, signals, electricity, and/or fluids.

Figure 2A:
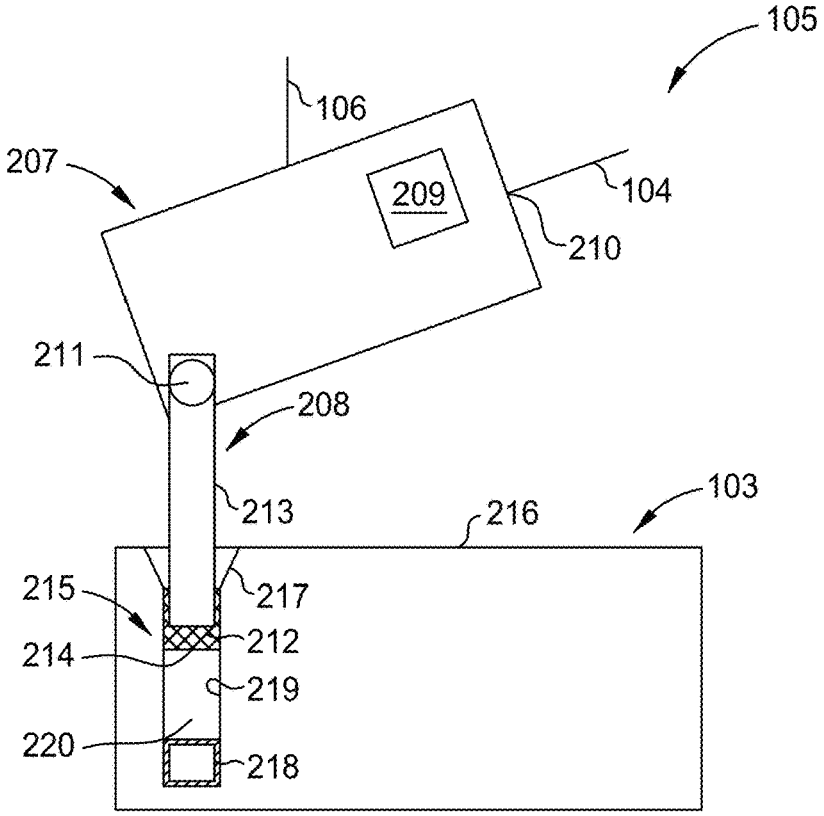
FIG. 2A illustrates a schematic view of an umbilical termination assembly (UTA) being guided into engagement with a subsea base structure, according to one or more embodiments.
Figure 2B:
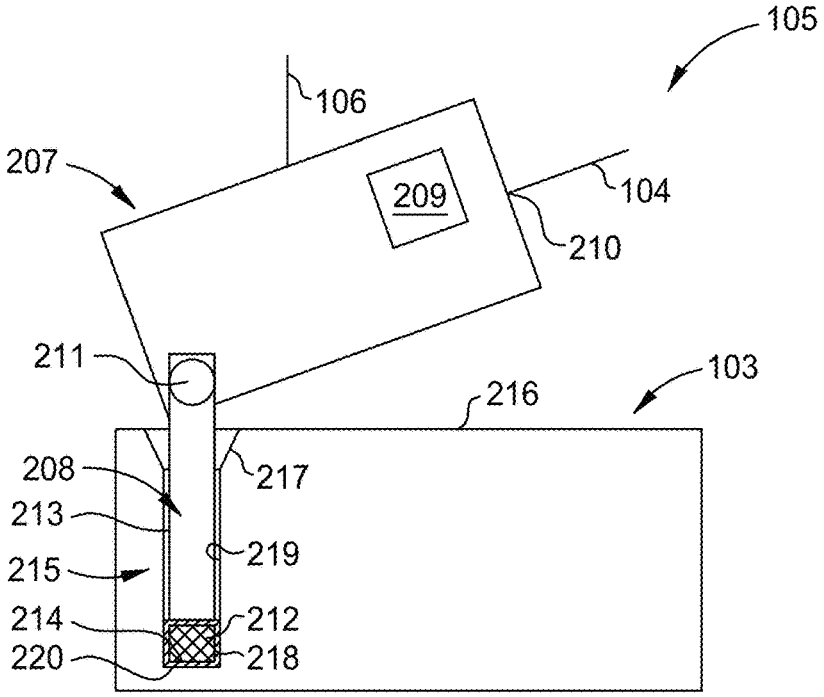
FIG. 2B illustrates a schematic view of the UTA of FIG. 2A in an intermediate position while being guided into engagement with the subsea base structure of FIG. 2A, according to one or more embodiments.
Figure 2C:
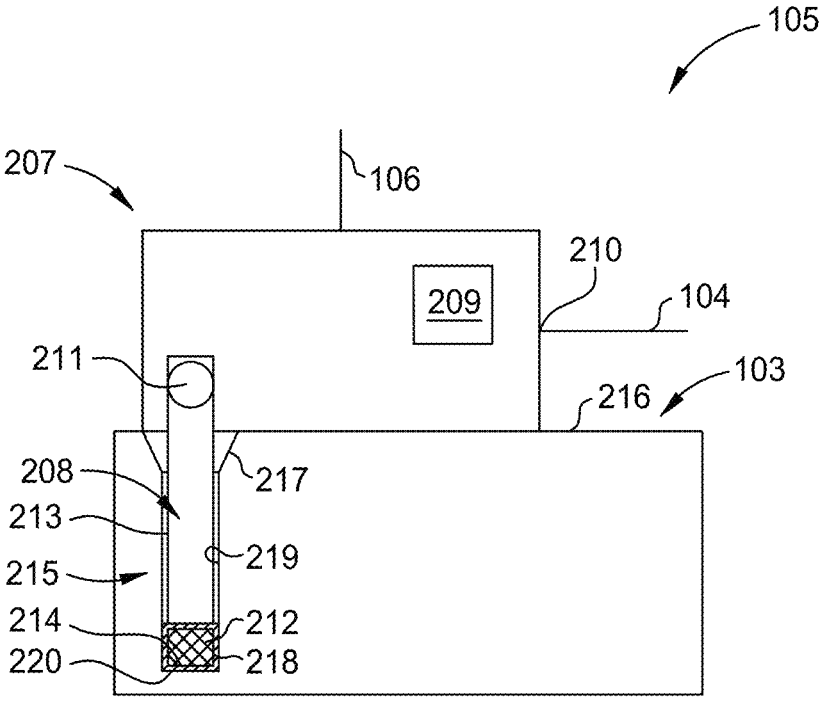
FIG. 2C illustrates a schematic view of the UTA of FIGS. 2A-2B engaged with the subsea base structure of FIGS. 2A-2B, according to one or more embodiments.

FIGS. 2A-2C illustrate the UTA 105 being guided into engagement with the subsea base structure 103. FIG. 2A illustrates the UTA 105 being engaged with the subsea base structure 103. FIG. 2B illustrates the UTA 105 partially engaged with the subsea base structure 103. FIG. 2C illustrates the UTA 105 in engagement with the subsea base structure 103.

The UTA 105 includes a body 207, a stab-in member 208, internal circuitry 209, and an umbilical connection 210. The umbilical connection 210 couples the umbilical 104 to the UTA 105. The internal circuitry 209 may include fluid circuitry (hydraulic circuitry or fluid transportation circuitry such as valves, tubes, pumps, etc.) or may include electric circuitry. The umbilical 104 is communicatively and/or electrically and/or fluidly coupled to the internal circuitry 209 by the umbilical connection 210. The internal circuitry 209 is, in-turn, coupleable to the base structure 103.

In one or more embodiments, the internal circuitry 209 includes cathodic protection (CP) circuitry. CP is a method to prevent corrosion of subsea steel structures (e.g., subsea base structure 103). Thus, CP circuitry may include anodes, such as galvanic anodes that can be coupled to the subsea steel structures that, when coupled to the subsea steel structures prevents corrosion of said subsea steel structures. In one or more embodiments, the galvanic anodes are installed remote to the UTA 105 (such as at the vessel 101 and/or the top side 102) and, rather, the internal circuitry 209 is configured to make an electrical connection between the remote anodes and the subsea steel structures.

The stab-in member 208 is used to guide the UTA 105 into engagement with the subsea base structure 103. One end of the stab-in member 208 is coupled to the UTA 105 by a hinge 211. Accordingly, the stab-in member 208 is pivotable about the hinge 211 (and that end of the stab-in member 208). The stab-in member 208 may pivot to protrude from the body 207 to case in guiding the UTA 105 into engagement and to allow the UTA 105 to fully engage with the subsea base structure 103 (as shown in FIG. 2C).

The stab-in member 208 includes a coupler 212 (e.g., an electrical coupler and/or a fluid coupler). The coupler 212 may be disposed on an outer surface 213 of the stab-in member 208. In one or more embodiments, the coupler 212 is disposed at a distal end 214 of the stab-in member 208. The coupler 212 is communicatively and/or electrically and/or fluidly coupled to the internal circuitry 209 of the UTA 105. Thus, the coupler 212 receives and is configured to transmit information, electricity, power, signals, and/or fluids.

The subsea base structure 103 includes a receptacle 215. The receptacle 215 is disposed in a surface 216 of the subsea base structure 103 and is shaped to receive the stab-in member 208. The receptacle 215 may be a hole or a bore, which may have a cross-sectional shape of a circle, oval, triangle, square, pentagon, hexagon, octagon, or any other suitable shape so long as the receptacle 215 can receive the stab-in member 208. According to one or more embodiments, the receptacle 215 includes a funnel 217 in the portion of the receptacle 215 nearest to the surface 216 of the base structure 103. The funnel 217 assists in guiding the stab-in member 208 into the receptacle 215.

The subsea base structure 103 further includes a coupler 218 (e.g., a fluidic and/or electrical coupler). The coupler 218 of the subsea base structure 103 is shaped and configured to receive the coupler 212 of the stab-in member 208. Accordingly, the coupler 218 of the subsea base structure 103 may be disposed in an inner surface 219 of the receptacle 215. In one or more embodiments, the coupler 218 of the subsea base structure 103 is disposed in a base surface 220 of the receptacle 215. The coupler 218 of the subsea bases structure 103 is communicatively and/or electrically and/or fluidly coupled to equipment (e.g., sensors, tools, valves, etc.) of the subsea base structure 103 requiring information, electricity, power, signals, and/or fluids. Accordingly, the coupler 218 of the subsea base structure 103 is configured to receive information, electricity, power, signals, and/or fluids from the coupler 212 of the stab-in member 208 and transmit the information, electricity, power, signals, and/or fluids to the equipment of the subsea base structure 103 requiring information, electricity, power, signals, and/or fluids. In one or more embodiments, the coupler 218 of the subsea base structure 103 electrically couples to (and/or grounds) the structure (e.g., a body) of the subsea base structure 103 to the UTA 105. Such an embodiment would be useful when the connection is used to CP and the internal circuitry 209 includes CP circuitry.

Accordingly, when the UTA 105 is engaged with the subsea base structure 103 (as shown in FIG. 2C) the umbilical connection 210 transmits information, power, electricity, signals, and/or fluids to and/or from the vessel 101, the information, power, signals, and/or fluids are routed to the internal circuitry 209, which are then routed to the coupler 212 of the stab-in member 208, the coupler 212 of the stab-in member 208 transmits the information, electricity, power, signals, and/or fluids to the coupler 218 of the subsea base structure 103, which then transmits the information, electricity, power, signals, and/or fluids to the respective equipment of the subsea base structure 103.

In one or more embodiments, only a portion of the information, power, signals, and/or fluids is transmitted through the couplers 212, 218. In such embodiments, the internal circuitry 209 and subsea base structure 103 may include connection points (not shown) including cables, lines, and/or hoses. Said connection points may separately communicatively couple the UTA 105 to the subsea base structure 103 by other methods (such as by an ROV after the UTA 105 is engaged with the subsea base structure 103).

According to one mode of operation (as shown in FIGS. 2A-2C), the UTA 105 is guided near engagement with the subsea base structure 103 (as shown in FIG. 2A). The stab-in member 208 is guided towards the receptacle 215 by the funnel 217 (as shown in FIG. 2B). The stab-in member 208 guides the UTA 105 into further engagement (e.g., by lowering the UTA 105). As the stab-in member 208 engages with the receptacle 215, the coupler 212 of the stab-in member 208 engages with the coupler 218 of the subsea base structure 103 thus communicatively and/or electrically and/or fluidly coupling the vessel 101 (or the top side 102) with the subsea base structure 103 (via the umbilical 104, the umbilical connection 210, the internal circuitry 209, the coupler 212, and the coupler 218) (as shown in FIG. 2B). Subsequently, the UTA 105 is rotated about the hinge 211 to engage the body 207 of the UTA 105 with the surface 216 of the base structure 103. In one or more embodiments wherein the internal circuitry 209 includes other connection points, the other connection points of the internal circuitry 209 may be coupled to connection points on the subsea base structure 103.

Figure 3:
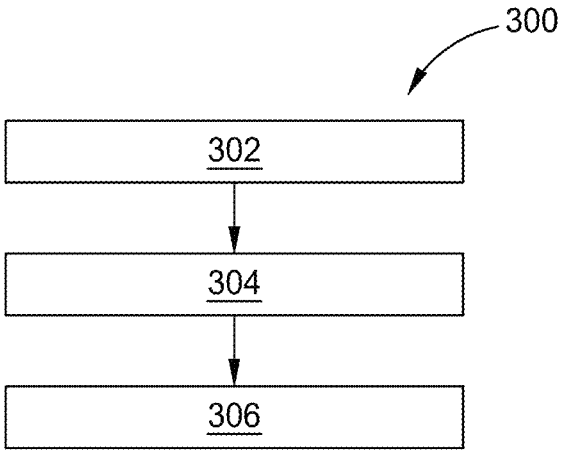
FIG. 3 illustrates a method for making an electrical connection between an umbilical termination assembly (UTA) and a subsea base structure, according to one or more embodiments.

FIG. 3 illustrates a method 300 for making a connection between a UTA (such as UTA 105 of FIGS. 1-2C) and a subsea base structure (such as subsea base structure 103 of FIGS. 1-2C).

At operation 302, the UTA is lowered (e.g., guided) towards engagement with the subsea base structure from a top side (such as top side 102) or a vessel (such as vessel 101) via a guide system (such as guide system 106). The UTA includes a body (such as body 207), a stab-in member (such as stab-in member 208), internal circuitry (such as internal circuitry 209), and an umbilical connection (such as umbilical connection 210) connecting an umbilical (such as umbilical 104) to the internal circuitry. In one or more embodiments, the stab-in member further includes a coupler (such as coupler 212) that may be an electrical coupler and/or fluid coupler. The UTA may further include any components mentioned above in the descriptions of FIGS. 1-2C.

At operation 304, the UTA is engaged with the subsea base structure. In one or more embodiments, engaging the UTA with the subsea base structure includes guiding the stab-in member into a receptacle (such as receptacle 215) in the base structure. In one or more embodiments, a funnel (such as funnel 217) of the receptacle may case in guiding the stab-in member into the receptacle.

At operation 306, the UTA is communicatively and/or electrically and/or fluidly coupled to the subsea base structure. In one or more embodiments, communicatively and/or electrically and/or fluidly coupling the UTA to the subsea base structure includes coupling the coupler of the stab-in member to a coupler of the subsea base structure (such as coupler 218 of the subsea base structure 103). Accordingly, communicatively and/or electrically and/or fluidly coupling the UTA to the subsea base structure communicatively and/or electrically and/or fluidly couples the top side (and/or vessel) to transmit information, electricity, power, signals, and/or fluids to and/or from the subsea base structure 103 (via the umbilical, the umbilical connection, the internal circuitry, the coupler of the stab-in member, and the coupler of the subsea base structure).

EXAMPLE ASPECTS

Aspect 1: An umbilical termination assembly (UTA). The UTA including a body, an umbilical, and a stab-in member. The body includes an umbilical connection and internal circuitry. The umbilical is configured to transmit information and power via electrical signals from a top side to the internal circuitry via the umbilical connection. The stab-in member is coupled to and protruding from the body. The stab-in member includes a stab-in electrical coupler. The stab-in electrical coupler is communicatively coupled to the internal circuitry and the umbilical connection and is configured to electrically couple the umbilical connection and internal circuitry to a base structure.

Aspect 2: The UTA of Aspect 1, wherein the stab-in electrical coupler is disposed in an outer surface of the stab-in member.

Aspect 3: The UTA of any of Aspects 1 or 2, wherein the stab-in electrical coupler is disposed at a distal end of the stab-in member.

Aspect 4: The UTA of any of Aspects 1-3, wherein the stab-in member is shaped to engage with a receptacle of the base structure.

Aspect 5: The UTA of Aspect 4, wherein the receptacle of the base structure includes a receiving electrical coupler, and wherein the stab-in electrical coupler is configured to electrically couple the umbilical connection and internal circuitry with the base structure through connection with the receiving electrical coupler.

Aspect 6: The UTA of Aspect 5, wherein the receiving electrical coupler is disposed in a base of the receptacle and the stab-in electrical coupler is disposed at a distal end of the stab-in member.

Aspect 7: The UTA of any of Aspects 1-6, wherein the internal circuitry includes cathodic protection (CP) circuitry, and wherein the stab-in electrical coupler is configured to electrically couple the CP circuitry to the base structure.

Aspect 8: A stab and hinge over (SHO) system. The SHO system includes a guide system, a base structure, and an umbilical termination assembly (UTA). The base structure is disposed on a sea floor below a top side and includes a receiving electrical coupler. The UTA includes a body, an umbilical, and a stab-in member. The body is coupled to the guide system and includes an umbilical connection and internal circuitry. The umbilical is configured to transmit information and power via electrical signals from the top side to the internal circuitry via the umbilical connection. The stab-in member is coupled to and protruding from the body. The stab-in member includes a stab-in electrical coupler. The stab-in electrical coupler is communicatively coupled to the internal circuitry and the umbilical connection and is configured to electrically couple the umbilical connection and internal circuitry to the receiving electrical coupler.

Aspect 9: The SHO system of Aspect 8, wherein the stab-in electrical coupler is disposed in an outer surface of the stab-in member.

Aspect 10: The SHO system of any of Aspects 8 or 9, wherein the stab-in electrical coupler is disposed at a distal end of the stab-in member.

Aspect 11: The SHO system of any of Aspects 8-10, wherein the stab-in member is shaped complementary to a receptacle of the base structure, and wherein the receptacle includes the receiving electrical coupler.

Aspect 12: The SHO system of Aspect 11, wherein the receiving electrical coupler is disposed in a base of the receptacle and the stab-in electrical coupler is disposed at a distal end of the stab-in member.

Aspect 13: The SHO system of any of Aspects 11 or 12, wherein the receptacle includes a funnel portion configured to guide the stab-in member into engagement with the receptacle.

Aspect 14: The SHO system of any of Aspects 8-13, wherein the internal circuitry includes cathodic protection (CP) circuitry, and wherein the stab-in electrical coupler is configured to electrically couple the CP circuitry to the base structure.

Aspect 15: The SHO system of any of Aspects 8-14, wherein the guide system includes a cable configured to lower the UTA into engagement with the base structure.

Aspect 16: A method of making an electrical connection. The method includes guiding an umbilical termination assembly (UTA) into engagement with a subsea base structure and electrically coupling the UTA with a base structure. The UTA includes a body, an umbilical, and a stab-in member. The body includes an umbilical connection and internal circuitry. The umbilical is configured to transmit information and power via electrical signals from a top side to the internal circuitry via the umbilical connection. The stab-in member is coupled to and protrudes from the body. The stab-in member includes a stab-in electrical coupler. The stab-in electrical coupler is communicatively coupled to the internal circuitry and the umbilical connection. Electrically coupling the UTA with the subsea base structure includes guiding the stab-in member into a receptacle of the base structure and coupling the stab-in electrical coupler with a receiving electrical coupler of the subsea base structure.

Aspect 17: The method of Aspect 16, wherein as the stab-in member engages with the receptacle, the stab-in electrical coupler electrically couples with the receiving electrical coupler.

Aspect 18: The method of any of Aspects 16 or 17, wherein the receiving electrical coupler is disposed in the receptacle.

Aspect 19: The method of Aspect 18, wherein the receiving electrical coupler is disposed in a base of the receptacle and the stab-in electrical coupler is disposed at a distal end of the stab-in member.

Aspect 20: The method of any of Aspects 16-19, wherein the internal circuitry includes cathodic protection (CP) circuitry, and wherein the stab-in electrical coupler is configured to electrically couple the CP circuitry to the base structure.

Any one or more components of the UTA 105 or subsea operation 100 may be integrally formed together, directly coupled together, and/or indirectly coupled together and are not limited to the specific arrangement of components illustrated in FIGS. 1-2C. Any one or more of the embodiments of the UTA 105 or subsea operation 100 may be combined in whole or part with any one or more of the embodiments of the UTA 105 or subsea operation 100.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions.

While the present disclosure has been described with respect to a number of embodiments and examples, those skilled in the art, having benefit of this disclosure, will appreciate that other embodiments can be devised, which do not depart from the scope and spirit of the present disclosure.

The preceding description, for purposes of explanation, uses specific nomenclature to provide a thorough understanding of the disclosure and is provided to enable any person skilled in the art to practice the various aspects described herein. However, it will be apparent to one skilled in the art that the specific details are not required to practice the systems and methods described herein. The examples discussed herein are not limiting of the scope, applicability, or aspects set forth in the claims. They are not intended to be exhaustive of or to limit this disclosure to the precise forms described. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. The examples are shown and described to best explain the principles of this disclosure and practical applications, to thereby enable others skilled in the art to best utilize this disclosure and various examples with various modifications as are suited to the particular use contemplated. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim. It is intended that the scope of this disclosure be defined by the claims and their equivalents below.

What is claimed is:

1. An umbilical termination assembly (UTA), comprising:

a body, the body including an umbilical connection and internal circuitry;

an umbilical configured to transmit information and power via electrical signals from a top side to the internal circuitry via the umbilical connection; and a stab-in member comprising a first end portion pivotally coupled to the body via a hinge and a second end portion comprising a stab-in electrical coupler communicatively coupled to the internal circuitry and the umbilical connection, wherein the stab-in member is coupled to and protruding from the body, and wherein the stab-in electrical coupler is fixed relative to the stab-in member and configured to electrically couple the umbilical connection and internal circuitry to a base structure.

2. The UTA of claim 1, wherein the stab-in electrical coupler is disposed in an outer surface of the second end portion of the stab-in member, and wherein the second end portion includes a distal end of the stab-in member.

3. The UTA of claim 1, wherein the stab-in member is shaped to engage with a receptacle of the base structure.

4. The UTA of claim 3, wherein the receptacle of the base structure includes a receiving electrical coupler, and wherein the stab-in electrical coupler is configured to electrically couple the umbilical connection and internal circuitry with the base structure through connection with the receiving electrical coupler.

5. The UTA of claim 4, wherein the receiving electrical coupler is disposed in a base of the receptacle and the stab-in electrical coupler is disposed at a distal end of the second end portion of the stab-in member.

6. The UTA of claim 1, wherein the internal circuitry includes cathodic protection (CP) circuitry, and wherein the stab-in electrical coupler is configured to electrically couple the CP circuitry to the base structure.

7. The UTA of claim 1, wherein the internal circuitry comprises electric circuitry and fluid circuitry, wherein the stab-in electrical coupler is configured to electrically couple the umbilical connection and the electric circuitry to the base structure, and wherein the second end portion of the stab-in member further comprises a stab-in fluid coupler configured to fluidly couple the umbilical connection and the fluid circuitry to the base structure.

8. The UTA of claim 1, wherein the stab-in member is configured to pivot between a first position and a second position, and wherein the stab-in member extends parallel to a bottom surface of the body in the first position and extends crosswise to the bottom surface of the body in the second position.

9. A stab and hinge over (SHO) system, including:

a guide system;

a base structure disposed on a sea floor below a top side, the base structure comprising a receiving electrical coupler; and an umbilical termination assembly (UTA), the UTA comprising:

a body coupled to the guide system, the body including an umbilical connection and internal circuitry;

an umbilical configured to transmit information and power via electrical signals from the top side to the internal circuitry via the umbilical connection; and a stab-in member comprising a first end portion pivotally coupled to the body via a hinge and a second end portion comprising a stab-in electrical coupler communicatively coupled to the internal circuitry and the umbilical connection, wherein the stab-in member is coupled to and protruding from the body, and wherein the stab-in electrical coupler is fixed relative to the stab-in member and configured to electrically couple the umbilical connection and internal circuitry to the receiving electrical coupler.

10. The SHO system of claim 9, wherein the stab-in electrical coupler is disposed in an outer surface of the second end portion of the stab-in member, and wherein the second end portion includes a distal end of the stab-in member.

11. The SHO system of claim 9, wherein the stab-in member is shaped complementary to a receptacle of the base structure, and wherein the receptacle includes the receiving electrical coupler.

12. The SHO system of claim 11, wherein the receiving electrical coupler is disposed in a base of the receptacle and the stab-in electrical coupler is disposed at a distal end of the second end portion of the stab-in member.

13. The SHO system of claim 11, wherein the receptacle includes a funnel portion configured to guide the stab-in member into engagement with the receptacle, and wherein the funnel portion comprises tapering sides.

14. The SHO system of claim 9, wherein the internal circuitry includes cathodic protection (CP) circuitry, and wherein the stab-in electrical coupler is configured to electrically couple the CP circuitry to the base structure.

15. The SHO system of claim 9, wherein the guide system includes a cable configured to lower the UTA into engagement with the base structure, and wherein the body of the UTA is configured to fully engage with a top surface of the base structure.

16. A method of making an electrical connection, comprising:

guiding an umbilical termination assembly (UTA) into engagement with a subsea base structure; and electrically coupling the UTA with the subsea base structure, wherein the UTA includes:

a body, the body including an umbilical connection and internal circuitry;

an umbilical configured to transmit information and power via electrical signals from a top side to the internal circuitry via the umbilical connection; and a stab-in member coupled to and protruding from the body, the stab-in member including a first end portion pivotally coupled to the body via a hinge and a second end portion comprising a stab-in electrical coupler, the stab-in electrical coupler fixed relative to the stab-in member and communicatively coupled to the internal circuitry and the umbilical connection, wherein electrically coupling the UTA with the subsea base structure includes guiding the stab-in member into a receptacle of the subsea base structure and coupling the stab-in electrical coupler with a receiving electrical coupler of the subsea base structure.

17. The method of claim 16, wherein as the stab-in member engages with the receptacle, the stab-in electrical coupler electrically couples with the receiving electrical coupler.

18. The method of claim 16, wherein the receiving electrical coupler is disposed in the receptacle.

19. The method of claim 18, wherein the receiving electrical coupler is disposed in a base of the receptacle and the stab-in electrical coupler is disposed at a distal end of the second end portion of the stab-in member.

20. The method of claim 16, wherein the internal circuitry includes cathodic protection (CP) circuitry, and wherein the stab-in electrical coupler is configured to electrically couple the CP circuitry to the subsea base structure.

* * * * *